US007217122B1

(12) United States Patent
Baird

(10) Patent No.: US 7,217,122 B1
(45) Date of Patent: May 15, 2007

(54) CANDLE WICK SNUFFER

(76) Inventor: Ian F. Baird, 26 Affonso Dr., Carson City, NV (US) 89706

( * ) Notice: Subject to any disclaimer, the term of this patent is extended or adjusted under 35 U.S.C. 154(b) by 107 days.

(21) Appl. No.: 11/099,269

(22) Filed: Apr. 5, 2005

Related U.S. Application Data

(60) Provisional application No. 60/559,582, filed on Apr. 5, 2004.

(51) Int. Cl.
*F23Q 35/00* (2006.01)
*F21V 35/00* (2006.01)

(52) U.S. Cl. ..... 431/35; 431/144; 431/289; 431/298

(58) Field of Classification Search ..... 431/21, 431/33, 35, 75, 144, 152, 289, 298; 362/159, 362/161; 337/4, 9, 10, 410, 411; 237/165; 131/237, 235.1, 256; 169/26, 42, 57; 102/275.1; 86/22

See application file for complete search history.

(56) References Cited

U.S. PATENT DOCUMENTS

| | | | | | |
|---|---|---|---|---|---|
| 134,113 | A * | 12/1872 | Washburn | 431/35 |
| 321,798 | A * | 7/1885 | Cox | 431/35 |
| 395,097 | A * | 12/1888 | Werntz | 431/35 |
| 428,673 | A * | 5/1890 | Gavin et al. | 431/294 |
| 601,754 | A * | 4/1898 | Kynast | 431/35 |
| 697,127 | A * | 4/1902 | Bogendoerfer | 431/35 |
| 763,440 | A * | 6/1904 | Stevenson | 431/35 |
| 767,892 | A * | 8/1904 | Isakson | 431/35 |
| 785,896 | A * | 3/1905 | Kuhnert | 431/35 |
| 828,238 | A * | 8/1906 | Nehr | 431/35 |
| 886,198 | A * | 4/1908 | Findlay | 431/35 |
| 910,022 | A * | 1/1909 | Savage | 431/21 |
| 1,116,477 | A * | 11/1914 | Peterson et al. | 361/124 |
| 1,367,921 | A * | 2/1921 | Pomije | 431/320 |
| 1,517,115 | A * | 11/1924 | Handler | 431/35 |
| 1,840,255 | A * | 1/1932 | Rinne | 131/256 |
| 1,867,420 | A * | 7/1932 | Root | 431/291 |
| 2,222,653 | A * | 11/1940 | Chambless et al. | 43/94 |
| 2,528,604 | A * | 11/1950 | McHollan | 362/447 |
| 2,736,322 | A * | 2/1956 | Ford | 131/256 |
| 3,756,252 | A * | 9/1973 | Vigorito | 131/256 |
| 6,282,832 | B1 * | 9/2001 | Manno | 43/81 |
| 6,361,311 | B1 * | 3/2002 | Smith | 431/291 |

FOREIGN PATENT DOCUMENTS

| | | |
|---|---|---|
| DE | 002822426 | * 12/1979 |
| DE | 29720900 | * 2/1998 |
| EP | 0483925 | * 5/1992 |
| JP | 10-16243 | * 6/1998 |
| WO | WO 87/03070 | * 5/1987 |

* cited by examiner

*Primary Examiner*—Carl D. Price
(74) *Attorney, Agent, or Firm*—Allen A. Dicke, Jr.

(57) ABSTRACT

The candle wick snuffer is mounted on a baseplate which is at the bottom of the candle. The baseplate carries a swing arm which is released when the temperature rises to critical point in the bottom of the candle. The baseplate may also carry a wick retainer to maintain the correct relative position between the swing arm of the candle wick snuffer and the wick. When the swing arm is released, it pulls the remaining wick down to snuff the candle flame.

20 Claims, 3 Drawing Sheets

FIG. 1
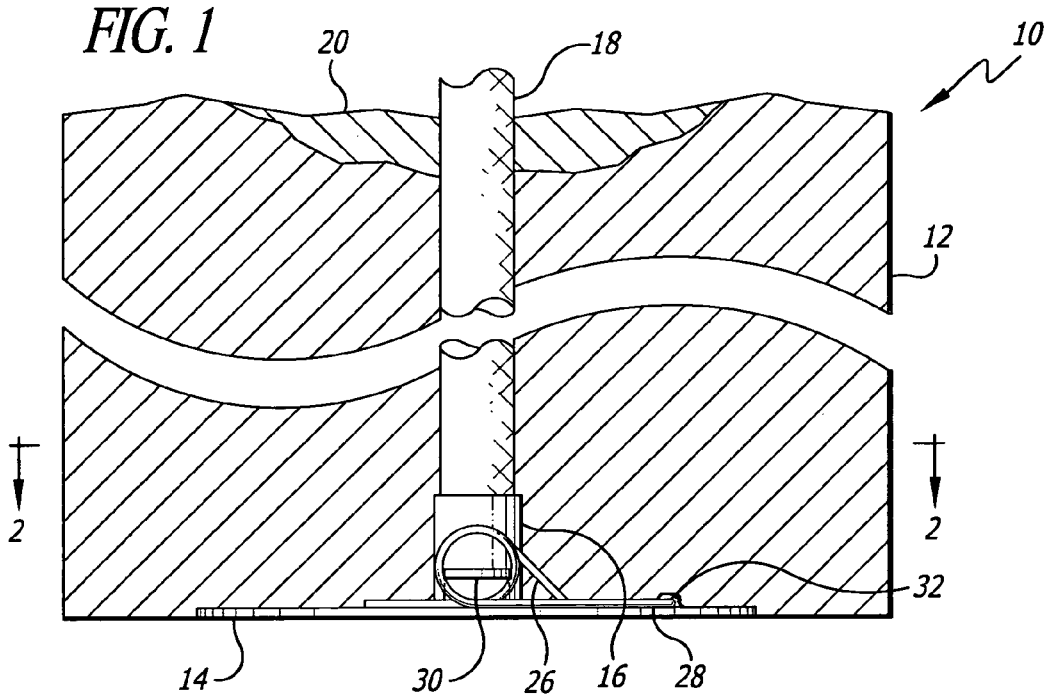
FIG. 2
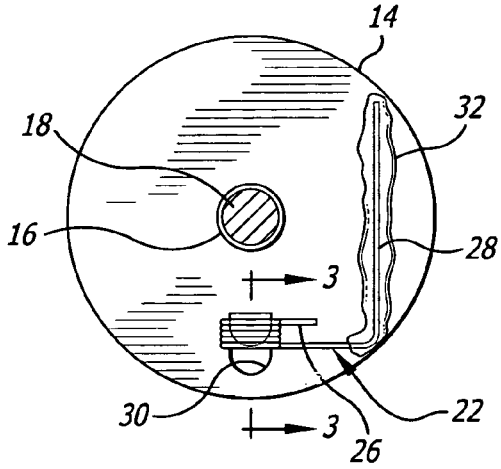
FIG. 3
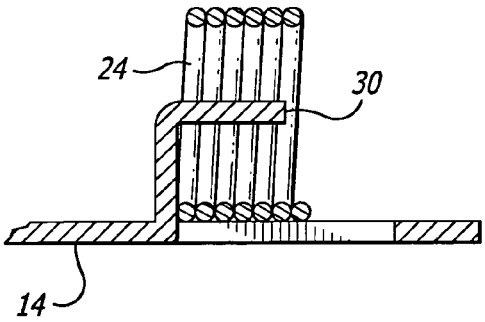
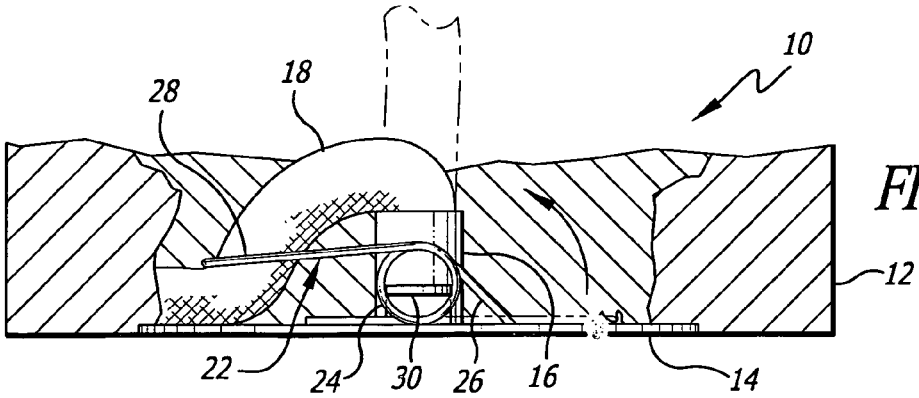
FIG. 4

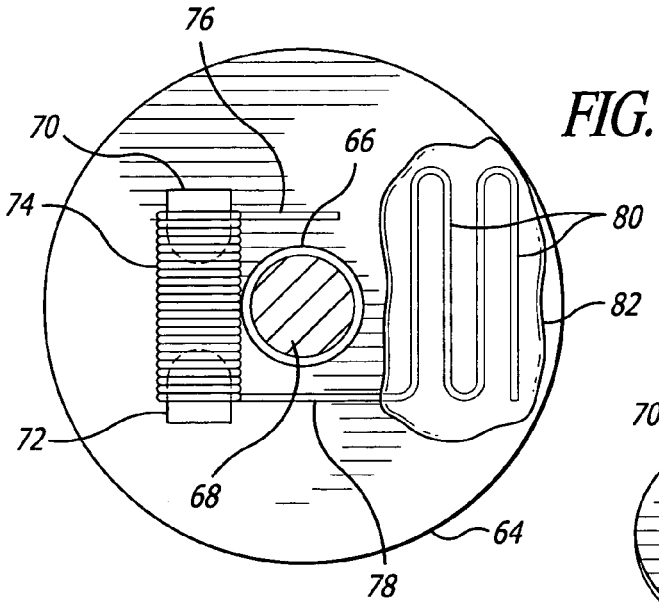
FIG. 9
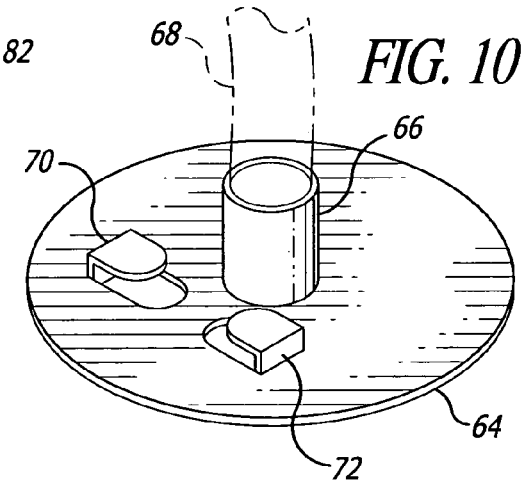
FIG. 10
FIG. 11
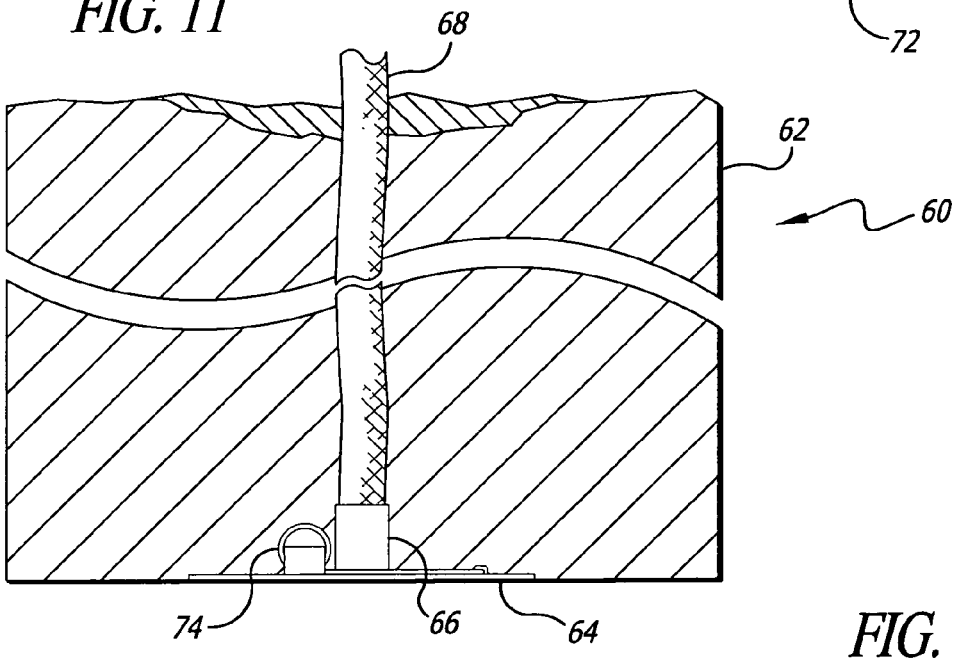
FIG. 12
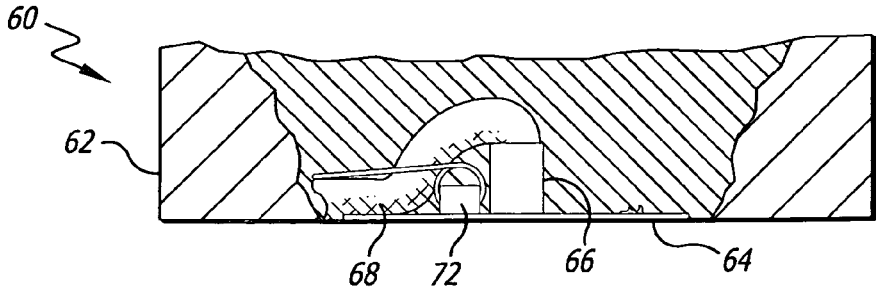

CANDLE WICK SNUFFER

CROSS REFERENCE

This application relies on prior Provisional Application Ser. No. 60/559,852, filed Apr. 5, 2004, for priority.

BACKGROUND OF THE INVENTION

Candles have been around for thousands of years. First used fuels were animal fat or tallow and later bees wax, then came the paraffin and vegetable based wax, and now an even newer synthetic polymer type of fuel. For candle fuels to burn, capillary action is employed. A fibrous material or cotton wick draws the liquid fuel up to the flame. Candles have evolved over time, and many additions have been added, such as color, fragrance, oil and novelty objects. The reasons to burn candles other than just for providing light are vast in number. Popularity has increased usage and, according to the National Fire Protection Association (NFPA), candles contribute to a high incidence of fires, causing injuries and loss of life as well as property damage in the millions of dollars.

The Fire Analysis and Research Division of NFPA reports that home candle fires increased 15 percent from the year 2000 to 2001, and 34 percent of these fires have been shown to be caused by negligence due to unattended, abandoned or inadequately controlled candles. Forgetting to extinguish a burning candle is a problem important enough to be dealt with and seriously remedied. A flame needs fuel and oxygen to survive, and lack of either will extinguish the flame. The end stages of candle burning are the most critical. Typically, as a candle flame burns downward to the bottom of the candle, the fuel is depleted and the wick burns out. In a freestanding candle, where the structure itself is also its fuel, a problem arises when the remaining fuel bottom loses its structure and evolves into a hot molten pool. If not adequately placed on a non-combustible surface, the molten fuel can saturate and ignite the supporting structure, producing a fire. A candle in a container has a different problem due to the fact the fuel's heat is intensified. If the heat is high enough to substantially vaporize the fuel, an explosive phenomenon known as flashover can occur, whereby it no longer needs a wick to burn. Excessive heat alone can scorch the paint or labels off of metal containers and crack or break glass containers, spilling forth the remaining contents, presenting a fire hazard.

All-wax or freestanding candles are usually manufactured in molds with or without retracting center rods, for wicks to be placed after rod withdrawal. Another method of manufacturing is molding fluid fuel into long tubes. A ram device forces the hardening fuel wax out of the die. The rod is cut to length, then center-bored for receiving a wick. A sized wick is then placed in the wick hole and affixed at its bottom with sometimes only a label for holding. Wicks poured in place are still the larger manufacturing method. The difference between whether the wick is placed during or after molding is purely a manufacturing process and has no significant effect on how it burns. The fuel must be fluid when poured into the mold or extrusion tube. Paraffin fuel has a pour temperature of 130 to 150 degrees F. Gel polymer fuel materials have a pour temperature of 160 to 170 degrees F. Some candles are made without a wick anchor. That type of candle must always be placed on a non-combustible surface due to the physical make-up. A burning candle wick with an unsupported bottom can float freely and migrate to an outer wall of the candle when the candle is low. Migration to an outer wall causes burning through and spilling molten fuel and the lit wick, setting the stage for a fire. Wick clips are provided to anchor the bottom of the wick and are typically made of thin metal. They are center-punched and crimped to hold a wick in a vertical, upright position during the manufacturing process. The wick clip is usually attached to the candle by the wax fuel, but sometimes only a bottom label holds it in place. When the candle flame has pooled its remaining fuel at the candle's bottom, the molten fuel's heat releases the wick clip from a fixed position. The unrestricted burning wick and clip can move freely within the molten fuel. If the burning wick is adjacent to an outer wall, it becomes a fire hazard. The candle bottom which once had structure is reduced to a molten state, now presenting a potential for fire.

Container candles use the same or similar type of wick anchor or clip although some have a longer cylindrical hollow ferrule or neck that is center-formed during manufacture. This keeps the wick from tilting or falling over when the fuel becomes molten during its burn. Containers are made of many non-combustible materials, but metal or glass is usually employed. Thus, there is need for a way in which candle safety can be improved.

SUMMARY OF THE INVENTION

To aid in the understanding of this invention, it can be stated in essentially summary form that it is directed to a candle wick snuffer. The candle wick snuffer is built into the bottom of the candle and comprises a baseplate which may also be the wick anchor plate. The baseplate carries a stressed spring which, when released, swings across the wick to bring the wick down into the molten fuel pool to snuff the flame. The spring is held in the stressed position by a temperature-sensitive adhesive so that the spring is released to cause snuffing when the adhesive reaches a critical temperature.

It is a purpose and advantage of the present invention to provide an improved candle wick snuffer which is incorporated into the base of the candle and which snuffs the flame and the wick when the candle fuel gets low.

It is another purpose and advantage of this invention to provide a candle wick snuffer which can be incorporated into the candle structure so that, when the candle fuel gets low, the candle wick snuffer is released to snuff the flame in the candle wick.

It is a further purpose and advantage of this invention to provide a candle wick snuffer which can be economically employed to increase the safety of candles.

It is a further purpose and advantage of this invention to provide a candle wick snuffer which is mounted on a baseplate, which also holds the bottom of the wick. The baseplate carries a stressed spring which is retained by temperature-sensitive adhesive so that, when the candle burns down, rising temperature releases the spring-loaded snuffer to extinguish the flame in the candle wick.

Other purposes and advantages of this invention will become apparent from a study of the following portion of the specification, the claims and the attached drawings.

BRIEF DESCRIPTION OF THE DRAWINGS

FIG. 1 is a side-elevational view of the first preferred embodiment of the candle wick snuffer of this invention, showing the base of the candle in section.

FIG. 2 is a plan view thereof, as seen generally along the line 2—2 in FIG. 1.

FIG. 3 is an enlarged view, as seen generally along the line 3—3 of FIG. 2.

FIG. 4 is a view similar to FIG. 1, showing the candle wick snuffer activated and the wick snuffed.

FIG. 9 is a plan view of a third preferred embodiment of the candle wick snuffer of this invention.

FIG. 10 is a perspective view of the baseplate used with the candle wick snuffer of FIG. 9.

FIG. 11 is a side-elevational view of the candle, incorporating the candle wick snuffer of FIG. 9, with the candle having ample fuel for further burning and the candle wick snuffer in the stressed position.

FIG. 12 is a similar view showing the candle fuel burned down and the candle wick snuffer in the actuated position.

DESCRIPTION OF THE PREFERRED EMBODIMENTS

Figure 5:
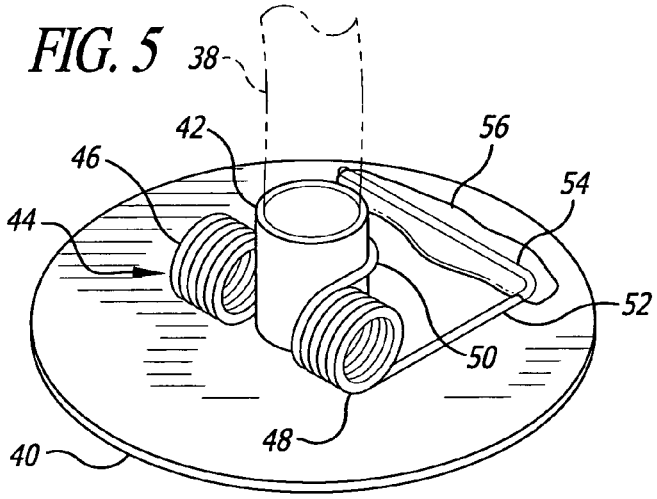
FIG. 5 is an isometric view of the second preferred embodiment of the candle wick snuffer of this invention.
Figure 7:
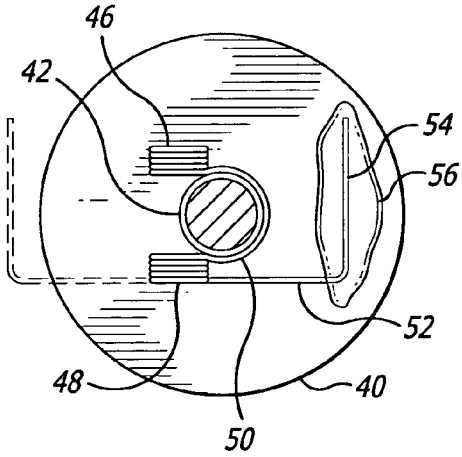
FIG. 7 is a plan view thereof on reduced scale, as seen generally along line 7—7 of FIG. 6.

Candle 10, shown in FIGS. 1 and 4, is formed of a body of solid fuel 12. At the bottom of the candle 12 is a baseplate 14, which is seen in FIGS. 1, 2, 3 and 4. The baseplate has a nose or collar 16 formed thereon, usually by punching up from the bottom. The collar can be of different heights, depending on the method of formation. Furthermore, it may not even be in the form of a collar, but a punchout in the baseplate to which a wick can be attached. The purpose of the collar is to hold the bottom end of wick 18 onto the baseplate, which secures the wick in place. The structure is known in the trade as a "wick sustainer." The wick may be positioned within the body of the candle by any conventional means, including forming the body around the wick or forming the fuel body, making a hole therethrough and placing the wick in the hole. When the wick is lit, the heat from the flame forms the liquid fuel pool 20. The liquid fuel moves up the wick by means of capillary action. The liquid vaporizes from the heat of the flame and then burns to maintain the thermal balance.

To this conventional candle structure, candle wick snuffer 22 is incorporated. The candle wick snuffer is comprised of a coil spring 24 which has a tail 26 and a sweep arm 28. The coil spring is mounted on a finger 30, which is pressed up out of the baseplate. The coil spring is tensioned so that the sweep arm wants to swing in the counterclockwise direction, as seen in FIG. 4. The sweep arm is initially retained in the clockwise position shown in FIGS. 1 and 2 by means of temperature-sensitive adhesive 32. When the baseplate is provided, the sweep arm is in the stressed and armed position shown in FIGS. 1 and 2. Thereupon, it is installed on the candle or the candle is formed thereon. In use, the candle is lit and the liquid fuel pool 20 is formed. The solid body of the fuel which forms the principal structure of the candle slowly melts from the heat of the flame, and the pool is fed up the wick to gasify and burn. This consumes the body of the candle. Ultimately, the fuel is melted down to the bottom or close to the bottom. The temperature which melts the body of the fuel is sufficiently high to melt the adhesive 32. This releases the sweep arm 28 and, due to the stress in the coil spring, the sweep arm 28 swings to the left, as seen in FIGS. 2 and 4. The sweep arm engages on the wick and drives it from the upright position to a position where it is quenched within the liquid pool. In this way, the candle is extinguished.

Figure 6:
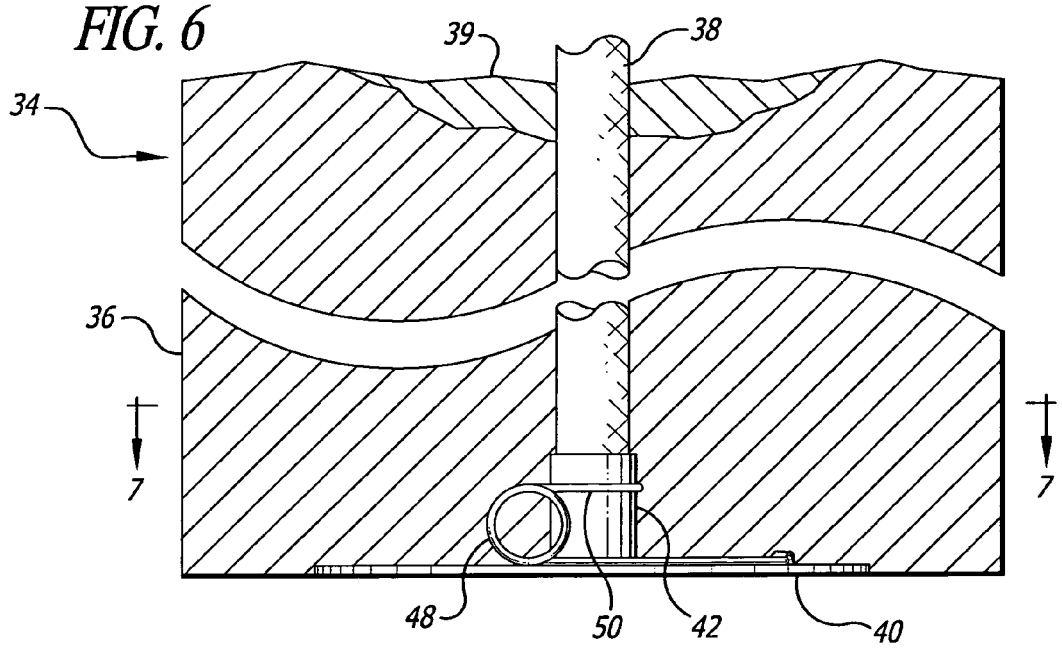
FIG. 6 is a side-elevational view thereof, showing the snuffer in stressed position and showing the candle in section.
Figure 8:
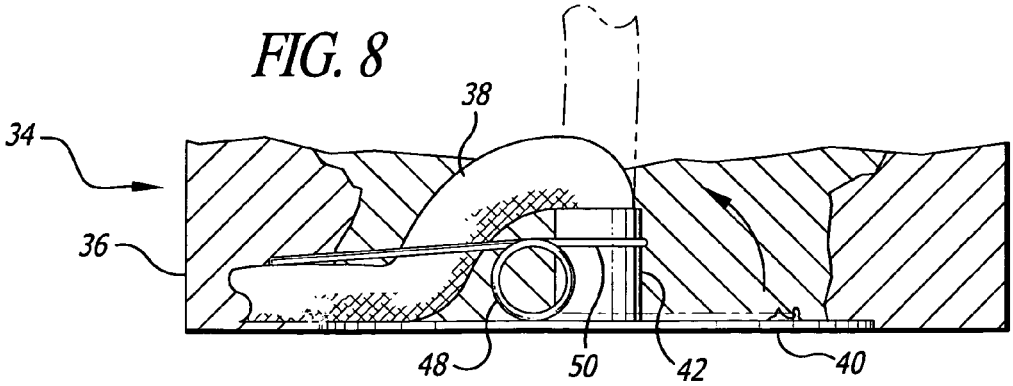
FIG. 8 is a side-elevational view thereof with the snuffer in the released position.

FIGS. 6 and 8 show a candle 34 having a fuel body 36. Wick 38 extends upward through the fuel body, as seen in FIG. 6, when the candle still has sufficient fuel to burn. Liquid fuel 39 provides the liquid which wicks up to the top where it vaporizes to burn. At the bottom of the candle, there is a baseplate 40 having a collar 42 which is mounted on the baseplate and extends upward therefrom. The collar may be a separate tube, but is preferably formed by the upward punching of the baseplate. In this embodiment of the invention, the collar serves as the structure by which the spring 44 is mounted on the baseplate 40. The spring 44 has first and second coil sections 46 and 48 connected by a curve tail 50. The tail is sized to snap around the collar 42 to hold the spring in place. Swing arm 52 extends from the coil 48 and has a portion radial to the coil 48 and a cross arm 54, which is crosswise to the wick. The spring is sized and configured so that the cross arm sweeps across the wick 38 when it is released. Prior to release, the cross arm is attached to the top of the baseplate 40 by means of temperature-sensitive adhesive 56. The temperature-sensitive adhesive melts at about 30 to 60 degrees F. Above the melting temperature of the fuel body of the candle. Therefore, when the fuel body melts and burns down close to the baseplate, the adhesive is released, and the tension in the spring causes the swing arm and cross arm to be released and swung across the position of the wick. The cross arm engages the wick and quenches in the liquid pool, as shown in FIG. 8. The swing arm and cross arm are the same as that shown with respect to the spring 44. Rather than a simple cross arm, if desired, a paddle can be formed on the spring or a paddle can be attached thereto.

The candle 60, shown in FIGS. 11 and 12, also has a fuel body 62, the same as the candles 10 and 34. Baseplate 64, also seen in FIGS. 9 and 10, has a collar 66 which serves as an anchor for the wick 68. In this embodiment, the candle wick snuffer has first and second ears 70 and 72, which are punched up out of the bottom of the baseplate. The ears extend toward each. Coil spring 74 has its tubular central coil engaged on the ears, as seen in FIG. 9. The coil spring includes a tail 76, which lies against the top of the baseplate. The coil spring has a sweep arm 78, which has on its end a plurality of cross arms 80. The cross arms are formed of a spring wire in a zigzag configuration to have a greater effective area. In the spring-stressed, armed position, the cross arms lie against the top of the baseplate and are retained thereon by means of temperature-sensitive adhesive 82. Instead of a plurality of cross arms, a flat panel can be used. After the candle wick snuffer is assembled, as shown in FIG. 9, it is placed into a candle, as shown in FIG. 11. When the candle burns down to a point where the temperature-sensitive adhesive releases the sweep arm, the remaining short wick is forced down into the liquid pool to quench the flame. The temperature sensitive adhesive has the same properties as the adhesive 32. The adhesive melting temperature is above the fuel melting temperature so that melted fuel can be poured thereon during candle manufacture without releasing the swing arm.

In each of these three embodiments, a spring is strained and held in place by a temperature-responsive structure. When the candle melts down to a dangerously low position, the temperature releases the structure which releases the swing arm so that the swing arm engages the wick and quenches its flame. In this way, safety is enhanced.

This invention has been described in its presently preferred embodiment, and it is clear that it is susceptible to numerous modifications, modes and embodiments within the ability of those skilled in the art and without the exercise of the inventive faculty. Accordingly, the scope of this invention is defined by the scope of the following claims.

The invention claimed is:

1. A candle wick snuffer comprising:

a baseplate configured to be placed on the bottom of the fuel body of a candle in the lower part of the candle body and positioned with respect to the candle wick;

a spring in the fuel body, a snuffer in the fuel body and mounted on said spring, said spring having an armed position wherein said candle wick snuffer is restrained with respect to said baseplate and a released position to which said snuffer is thrust when said snuffer is released, said snuffer moving through the candle wick position as it moves from its armed to its released position; and temperature-sensitive structure separate from the candle fuel body releasably retaining said snuffer in its armed position so that said snuffer is released when said temperature-sensitive structure releases substantially at the melting temperature of candle fuel body so that said snuffer moves through the wick position to thrust the wick into the candle fuel melt pool.

2. The candle wick snuffer of claim 1 wherein said snuffer has a cross arm on said spring, said cross arm being adhesively restrained in armed position against said baseplate.

3. The candle wick snuffer of claim 2 wherein said spring is a coil spring which is mounted with respect to said baseplate.

4. The candle wick snuffer of claim 3 wherein said coil spring is mounted on a finger mounted on said baseplate.

5. The candle wick snuffer of claim 4 wherein said coil spring is mounted on two fingers formed on said baseplate.

6. The candle wick snuffer of claim 3 wherein said baseplate has a collar thereon, said collar being for retention of the lower end of the candle wick, said spring being mounted on said collar.

7. The candle wick snuffer of claim 3 wherein said spring has a tail opposite said snuffer, said tail engaging on said baseplate.

8. The candle wick snuffer of claim 7 wherein said spring is a coil spring having multiple turns.

9. The candle wick snuffer of claim 3 wherein said baseplate has a collar thereon for retention of the lower end of a candle wick and said spring has a tail which engages at least partly around said collar.

10. A candle with a candle wick snuffer therein comprising:

a candle comprising a candle fuel body having a top end and a bottom end, a candle wick in said fuel body extending from bottom end to said top end;

a baseplate within said candle fuel body, said baseplate being configured to be positioned in the bottom of said candle fuel body and adjacent said wick in the bottom of said candle fuel body, said baseplate having structure thereon for engaging said wick in the bottom of said candle;

a spring, said spring having a tail and having a snuffer arm, said spring being mounted on said baseplate within said candle body and said tail engaging said baseplate, said spring having an armed position wherein said snuffer arm is releasably restrained in the armed position, temperature-sensitive adhesive separate from said fuel body releasably retaining said snuffer arm in its armed position, said snuffer arm being moved to released position by action of said spring when said temperature-sensitive adhesive releases said snuffer arm, said snuffer arm being configured to pass across the position of said candle wick as it moves from its armed positioned to its released position so that said candle wick is moved and its flame is snuffed in the melted fuel pool adjacent said wick.

11. The candle wick snuffer of claim 10 wherein said spring is a coil spring, and the coil of said coil spring is engaged on a finger on said baseplate.

12. The candle wick snuffer of claim 10 wherein said spring is a coil spring and the coil of said coil spring is retained on first and second fingers on said baseplate engaging into the coil of said coil spring.

13. The candle wick snuffer of claim 10 wherein said snuffer arm is comprised of a swing arm integral with and extending from said spring and a cross spring integral with said swing arm which passes the position of the wick when said snuffer arm is moved from its armed position to its released position to snuff the wick in the fuel melt pool.

14. The candle wick snuffer of claim 13 wherein said cross arm is larger than said swing arm.

15. The candle wick snuffer of claim 11 wherein said snuffer arm is comprised of a swing arm extending from said spring and a cross spring which passes the position of the wick when said snuffer arm is moved from its armed position to its released position.

16. The candle wick snuffer of claim 12 wherein said snuffer arm is comprised of a swing arm extending from said spring and a cross spring which passes the position of the wick when said snuffer arm is moved from its armed position to its released position.

17. The candle wick snuffer of claim 10 wherein said baseplate has a collar thereon sized and positioned to receive the bottom of a candle wick.

18. The candle wick snuffer of claim 17 wherein said tail of said spring resiliently engages around said collar to retain said spring with respect to said base.

19. A candle wick snuffer comprising:

a baseplate configured to be placed within the fuel body in the bottom of a candle, said baseplate having structure thereon for positioning and securing the bottom of a candle wick with respect to said baseplate;

a coil spring, structure engaging said coil spring to retain said coil spring with respect to said base, said coil spring having a tail to restrain rotation of said coil spring with respect to said baseplate, said coil spring having a swing arm integral thereto extending from said coil spring and a cross arm integral thereto on said swing arm, said cross arm having an armed position and a released position, temperature-sensitive adhesive separate from the candle fuel body releasably retaining said cross arm in its armed position, said temperature-sensitive adhesive releasing said cross arm when the temperature of said adhesive reaches substantially the melting point of candle wax, said cross arm having a path from its armed positioned to its released position which carries said cross arm across the position of the wick of the candle to move the wick of the candle in a manner in which flame is snuffed.

20. The candle wick snuffer of claim 19 wherein said coil spring is mounted with respect on said baseplate.

* * * * *